United States Patent [19]

Chang

[11] Patent Number: 4,644,249

[45] Date of Patent: Feb. 17, 1987

[54] COMPENSATED BIAS GENERATOR VOLTAGE SOURCE FOR ECL CIRCUITS

[75] Inventor: Benny Chang, South Portland, Me.

[73] Assignee: Quadic Systems, Inc., South Portland, Me.

[21] Appl. No.: 758,956

[22] Filed: Jul. 25, 1985

[51] Int. Cl.[4] ..... G05F 1/652

[52] U.S. Cl. ..... 323/223; 323/299; 323/313; 323/907

[58] Field of Search ..... 323/223, 226, 299, 303, 323/313, 315, 907

[56] References Cited

U.S. PATENT DOCUMENTS 4,061,959 12/1977 Ahmed ..... 323/313
4,490,670 12/1985 Wong ..... 323/313
4,533,842 8/1985 Yang et al. ..... 323/313

*Primary Examiner*—Peter S. Wong
*Assistant Examiner*—Judson H. Jones
*Attorney, Agent, or Firm*—Daniel H. Kane, Jr.

[57] ABSTRACT

A voltage compensated bias generator voltage source includes an all NPN active collector load circuit operatively coupled between the line voltage $V_{cc}$ and the collector of the shunt regulator transistor of the bias generator. The all NPN active collector load circuit logarithmically reduces variation in shunt regulator transistor collector current with variations in the line voltage $V_{cc}$. A transistor of the active collector load circuit also provides in combination with an output transistor of the bias generator a Darlington transistor pair of ECL current source voltage $V_{cs}$. A temperature variation countervailing third transistor is also operatively coupled in the active collector load circuit to compensate for temperature variation problems introduced by the active collector load circuit itself. The temperature variation countervailing active collector load circuit actually reverses the effect of temperature on the shunt regulator transistor collector current for substantial linearizing of the dependence of bias generator outputs on temperature variation.

16 Claims, 5 Drawing Figures

FIG I (PRIOR ART)

COMPENSATED BIAS GENERATOR VOLTAGE SOURCE FOR ECL CIRCUITS

TECHNICAL FIELD

This invention relates to bias generators for generating the reference voltage $V_{bb}$ and the current source voltage $V_{cs}$ for emitter coupled logic (ECL) circuits and in particular to new active collector load circuits which provide voltage compensated sources over a wide range of variations in the line voltage $V_{cc}$ and over a broad temperature range.

BACKGROUND ART

ECL gates, switches or circuits generally include a pair of transistors providing alternative transistor collector paths from a high potential line voltage $V_{cc}$ at ground or zero volts. The transistors are operatively coupled with a common emitter coupling for switching current between the collector paths according to input signals at the base of one of the transistors designated the input transistor. A current source $V_{cs}$ is coupled between the common emitter coupling and a negative potential $V_{ee}$ at, for example, −5.2 volts +0.5 volts, for generating current in the alternate transistor collector paths.

The input transistor receives ECL input data signals at the base of the input transistor. The other transistor constitutes a reference transistor and a negative reference voltage $V_{bb}$ typically in the range of −1.2 to −2.0 volts is applied to the base of the reference transistor to establish the relative level of the high and low level data signals in the negative voltage range. The output of the ECL gate, switch or circuit is obtained from the collector nodes of the ECL transistors typically through emitter follower buffer transistors which provide current gain and shift the voltage levels.

The voltage sources for the reference volta $V_{bb}$ and the ECL current source voltage $V_{cs}$ are generally provided by a separate bias generator or bias voltage source for operation of the ECL circuit in the selected negative voltage range. For example, the reference voltage $V_{bb}$ is typically selected to be in the range of −1.2 to −2.0 volts. The high level or logic "1" data signals are therefore typically in the range of −0.8 to −1.6 volts while the low level or logic "0" data signals are for example in the range of −1.6 to −2.4 volts according to the selected value of the reference voltage $V_{bb}$. The ECL current generator or current source $V_{cs}$ is preferably compensated so that the ECL gate or switch can operate despite variations of the line voltage source $V_{cc}$.

A prior art voltage compensated bias generator or voltage source for the reference voltage $V_{bb}$ and the current source $V_{cs}$ is illustrated in FIG. 1. Shunt regulator transistor Q3 stabilizes the output voltage for the current source voltage $V_{cs}$ and reference voltage $V_{bb}$. The current source voltage $V_{cs}$ may be tied to the emitter of either output transistor Q5 or output transistor Q6. The collector current in transistor Q5 together with resistor R5 establishes the voltage level of reference voltage $V_{bb}$ while buffer transistor Q7 buffers the reference voltage source $V_{bb}$ to provide a low impedance source.

Similarly, the current source voltage $V_{cs}$ is a low impedance source buffered by either transistors Q5 or Q6. The level of the current source voltage $V_{cs}$ is set by resistor R3 and related components as hereafter described.

The base collector shorted transistor Q8, base resistor R7, transistor Q4 and emitter resistor R4 establish the collector current $I_C$Q4 through transistor Q4. The collector current $I_C$Q4, plus the current $I_{RT}$ through temperature dependence resistance $R_T$ plus the base current $I_B$Q3 through shunt regulator transistor Q3 set the voltage drop across resistor R3. The voltage level of current source $V_{cs}$ is therefore set by the voltage dro $V_{R3}$ across resistor R3 and the voltage drop $V_{BE}$Q3 across the base emitter junction of shunt regulator transistor Q3.

By this circuit coupling arrangement the voltage level of current source voltage $V_{cs}$ tends to be stabilized because for example if $V_{cs}$ begins to fall the base drive to shunt regulator transistor Q3 decreases, the collector current $I_C$Q3 decreases, and the base potential of transistor Q5 rises tending to stabilize the current source voltage $V_{cs}$. In conventional bias generators for ECL circuits however the collector current of shunt regulator transistor Q3 is subject to variation from variations in the line voltage $V_{cc}$. This will result in undesirable variations in the bias generator outputs $V_{bb}$ and $V_{cs}$ due largely to changes in the base emitter potential of transistor Q3. For high performance ECL circuits, voltage compensation in response to variations of the line voltage $V_{cc}$ for regulating the shunt regulator transistor collector current $I_C$Q3 is accomplished by an active collector load circuit which conventionally incorporates a PNP-type transistor Q9 in the collector circuit of shunt regulator transistor Q3. The collector current of transistor Q3 is set by the base emitter potential of transistor Q9 and resistor R6 and is only logarithmically dependent upon the line voltage Vcc.

A disadvantage of the conventional active collector load circuit is that high performance ECL circuits are generally fabricated with an all NPN bipolar process and it is difficult to fabricate a PNP-type transistor in such a process. Furthermore, the active collector load circuit itself introduces temperature variation problems while compensating for variations in the power supply line voltage $V_{cc}$. In particular, the output voltage sources $V_{bb}$ and $V_{cs}$ exhibit a significantly non-uniform rate of change with temperature, thus restricting the operating temperature range of high performance ECL circuits.

As illustrated in the graph of FIG. 2, in the conventional prior art bias generator, as the temperature increases, the $V_{BE}$'s of the respective transistors decrease while the resistances of the various resistors increase thereby reducing the collector current $I_C$Q3 of the shunt regulator transistor. As the device cools down the potential drop $V_{BE}$ across the base emitter junctions of the transistors increases while the resistances of the respective resistors decrease thereby increasing the collector current $I_C$Q3. It is this temperature variation in the shunt regulator transistor collector current $I_C$Q3 introduced by the conventional active collector load circuit that produces undesirable variations in the reference voltage output $V_{bb}$ and the current source voltage output $V_{cs}$ affecting the operation of ECL gates, switches and circuits serviced by the bias generator voltage source.

The operating temperature range of the conventional bias generator and associated ECL circuits is substantially limited. A linear variation of the output voltage source $V_{bb}$ with temperature is most desirable. However, the active collector load causes significant nonlinearity in the variation of the output voltage source $V_{bb}$ with temperature as illustrated in FIG. 3. A disadvantage of the prior art limitation is that the circuits are not adequate for the broader operating temperature ranges of for example −55° C. to +175° C. required in many applications.

OBJECTS OF THE INVENTION

It is therefore an object of the present invention to provide a new bias generator voltage source for ECL circuits which is compensated for variations in power supply line voltage using an all NPN active collector load circuit for the shunt regulator transistor compatible with an all NPN bipolar integrated circuit fabrication process.

Another object of the invention is to provide a voltage compensated bias generator voltage source for ECL circuits using an all NPN active collector load circuit which also compensates for temperature variation problems introduced by the active collector load circuit itself.

A further object of the invention is to provide a voltage compensating, temperature countervailing active collector load circuit for the shunt regulator transistor of bias generator voltage sources which in effect inverses or reverses the variation of shunt regulator transistor collector current $I_C$Q3 with temperature for shaping the voltage outputs of the bias generator to extend the operating range of ECL circuits with which the bias generator is used. More specifically, it is intended by the present invention to provide a compensating active collector load circuit which supplies collector current to the shunt regulator transistor that increases with temperature, just the inverse or reverse of the effect introduced by conventional active collector load circuits. The rate of change of the voltage drop across the base emitter junction of the shunt regulator transistor $V_{BE}$Q3 remains relatively uniform over a broad temperature range, i.e., $dV_{BE}Q3/T \cong K$, where "K" is a constant.

DISCLOSURE OF THE INVENTION

In order to accomplish these results the present invention provides a voltage compensated bias generator having an all NPN active collector load circuit operatively coupled between the line voltage power supply $V_{cc}$ and the collector of the shunt regulator transistor. The active collector load circuit includes NPN first and second transistors with the base of the first transistor coupled to the emitter of the second transistor and with the base of the second transistor coupled to the collector of the first transistor. The active collector load circuit is operatively coupled to provide a first relatively smaller changing current from the emitter of the first transistor varying with changes in the line voltage $V_{cc}$ and a relatively larger second substantially unvarying standing current from the emitter of the second transistor. The smaller changing current and larger standing current are combined in the circuit to provide the collector current to the shunt regulator transistor thereby substantially logarithmically reducing variation in collector current from the active collector load circuit to the shunt regulator transistor upon variations in the line voltage power supply $V_{cc}$.

A feature and advantage of the invention is that the voltage compensated bias generator may be fabricated as an all NPN bipolar integrated circuit. Furthermore, the all NPN active collector load circuit is operatively coupled in the bias generator so that the second transistor of the active collector load circuit provides in combination with an output transistor of the bias generator a Darlington transistor pair for sourcing current and driving the current source voltage $V_{cs}$ providing a lower impedance current source voltage for ECL circuits.

According to a preferred embodiment of the invention a temperature variation countervailing or compensating NPN third transistor is coupled in the active collector load circuit. The third temperature countervailing transistor is operatively coupled to the first and second transistors to reverse the effect of temperature on the collector current supplied to the shunt regulator transistor. Thus, the compensating active collector load circuit of the present invention may be constructed and arranged for increasing the shunt regulator transistor collector current $I_C$Q3 with increase in temperature, just the inverse of conventional compensated bias generators. The curve of temperature compensation or countervailing temperature effect is selected to compensate for temperature variations in the base emitter voltage $V_{BE}$ of the shunt regulator transistor Q3 itself. As a result, rate of change of the $V_{BE}$ of the shunt regulator transistor with temperature remains relatively uniform over a broad temperature range, of for example −55° C. to +175° C., i.e., $dV_{BE}/dT = K$, where "K" is a contant. For ECL circuits that require an ECL voltage swing increase with temperature, the present invention can also provide a slight increase in the current source voltage output $V_{cs}$ of, for example, 1.1 mv/° C. compatible with existing ECL families.

At the same time the active collector load circuit according to the present invention effects a logarithmic reduction in variation of the collector current $I_C$Q3 with changes in the line voltage $V_{cc}$. The beneficial result of the all NPN compensated active collector load circuit according to the present invention is that the output voltage sources $V_{bb}$ and $V_{cs}$ remain substantially constant despite variations in line voltage $V_{cc}$ while at the same time showing a significantly more linear change with temperature over a broad operating temperature range.

Other objects, features and advantages of the present invention are apparent in the following specification and accompanying drawings.

DESCRIPTION OF PREFERRED EXAMPLE EMBODIMENTS AND BEST MODE OF THE INVENTION

Figure 1:
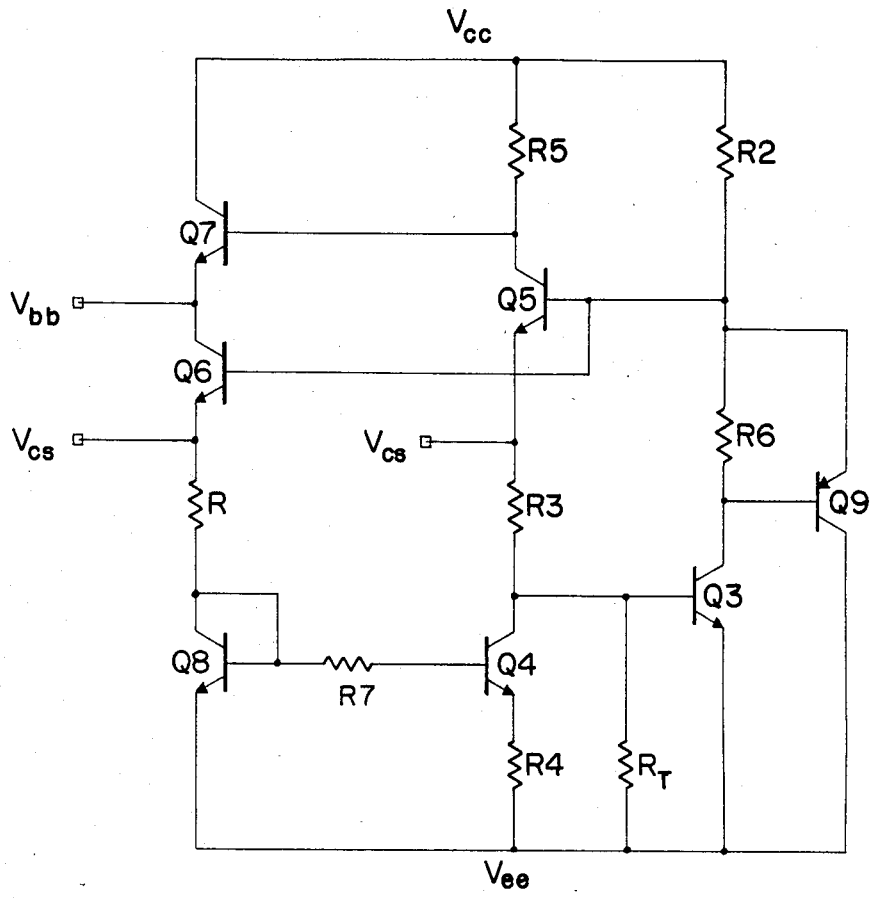
FIG. 1 is a schematic diagram of a prior art compensated bias generator voltage source for ECL circuits.
Figure 4:
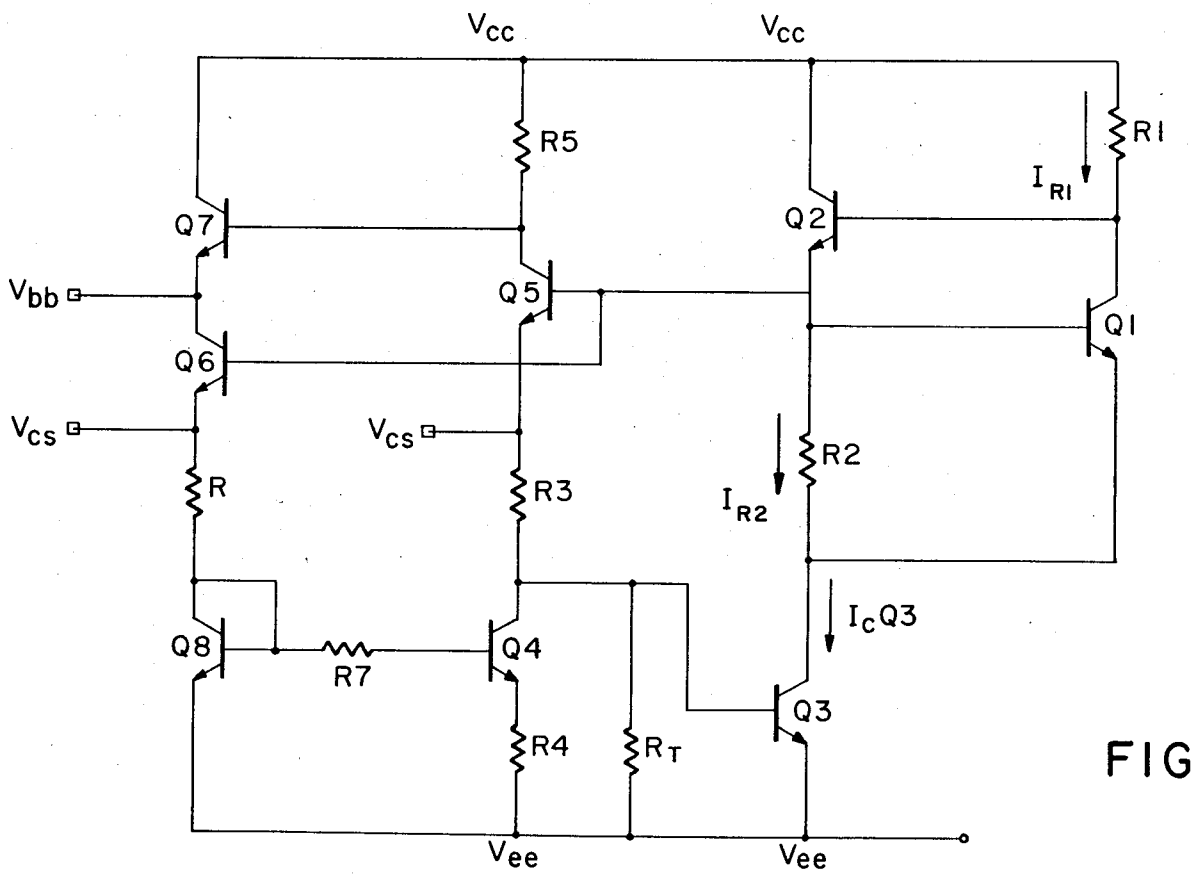
FIG. 4 is a schematic diagram of a fragmentary circuit portion of a bias generator according to the present invention showing the all NPN active collector load circuit.

A fragmentary portion of a bias generator voltage source incorporating an all NPN active collector load circuit according to the present invention is illustrated in FIG. 4. The remainder of the bias generator circuit or bias network may be the same for example as the bias generator circuit illustrated in FIG. 1. The all NPN active collector load circuit is provided by a first NPN transistor Q1 and collector resistor R1 selected to provide a relatively small first collector current component $I_{R1}$ (or simply $I_1$) which may vary with changes in the line voltage $V_{cc}$; and a second NPN transistor Q2 and emitter resistor R2 selected to provide a relatively larger unvarying collector current component or standing current $I_{R2}$ (or simply $I_2$). The base of the first transistor Q1 is coupled to the emitter of the second transistor Q2, while the base of the second transistor Q2 is coupled to the collector of the first transistor Q1. The parallel paths provided by resistor R1/transistor Q1 and transistor Q2/resistor R2 from the line voltage $V_{cc}$ are coupled together at the collector of shunt regulator transistor Q3 so that the collector current components $I_{R1}$ and $I_{R2}$ ($I_1$ and $I_2$) combine to form the shunt regulator transistor collector current $I_C$Q3 with logarithmic reduction in variation of $I_C$Q3 with variations in the line voltage power supply $V_{cc}$.

For example, if the circuit parameters are selected so that the standing current comprises 90% of the shunt regulator tranistor collector current $I_C$Q3, then variations in the bias generator voltage source output with variations in line voltage can be limited to 5 mv (output)/volt ($V_{cc}$).

A feature and advantage of the all NPN bias generator active collector load circuit according to the invention is that the transistor configuration provides at the bias generator output a Darlington transistor pair for sourcing current and delivering a lower impedance current source $V_{cs}$ than the prior art conventional bias generator. Referring to FIG. 4, it is apparent that the second transistor, transistor Q2 of the active collector load circuit combines with the current source output voltage transistor Q5 to provide the Darlington transistor pair drive. The remainder of the bias generator circuit of FIG. 4 may for example follow the circuit arrangement illustrated in FIG. 1.

Figure 5:
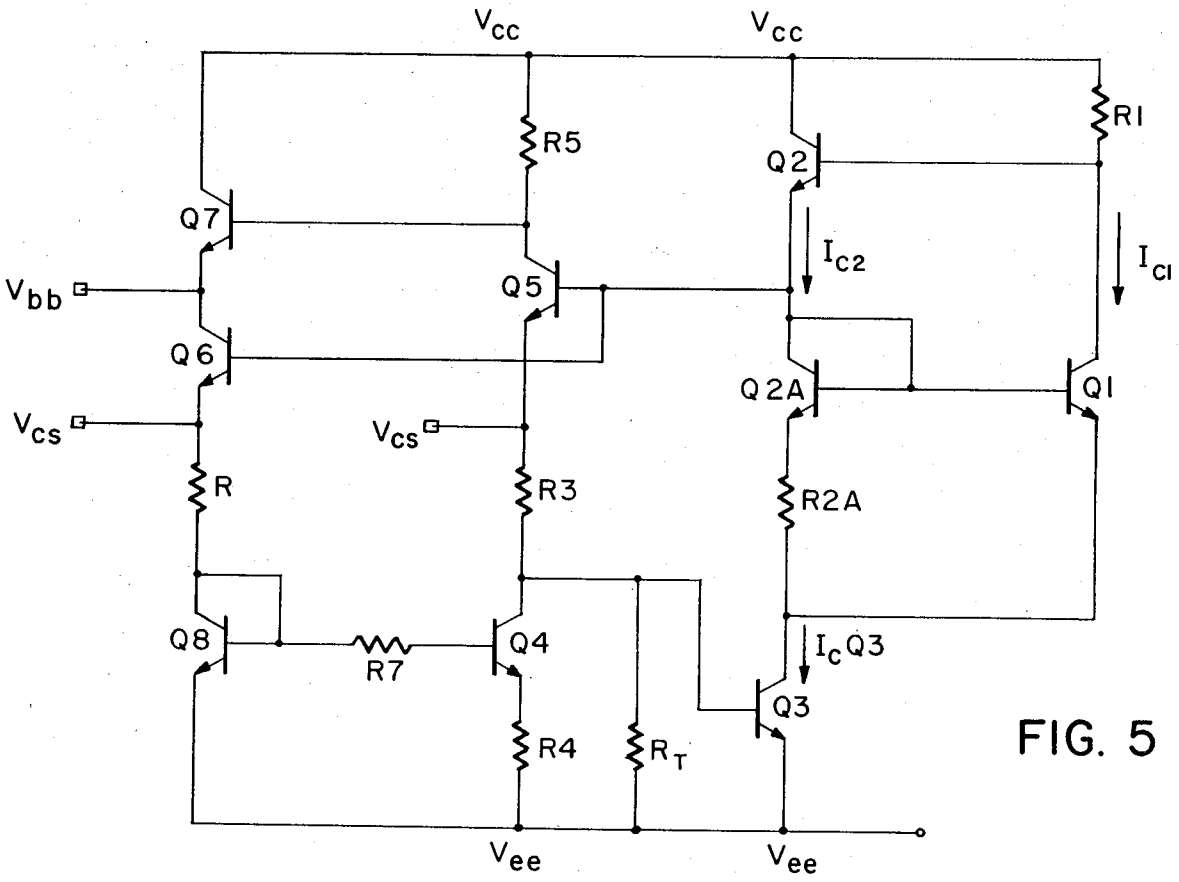
FIG. 5 is a schematic diagram of a fragmentary portion of a bias generator voltage source according to the present invention showing an all NPN countervailing temperature active collector load circuit according to the invention.

A bias generator or bias network with temperature variation countervailing active collector load circuit according to the present invention to compensate for temperature variation problems introduced by the active collector load circuit itself is illustrated in FIG. 5. Circuit components performing the same function as in FIG. 4 are indicated by the same reference designation. In addition there has been added to the active collector load circuit a third NPN transistor Q2A which functions as a temperature variation countervailing or temperature compensating transistor. As shown in FIG. 5, the base of the third transistor Q2A is coupled to the base of the first transistor Q1, and the collector of the third transistor Q2A is coupled to the emitter of the second transistor Q2. Because the third transistor Q2A is a base collector shorted resistor, the base of the first transistor Q1 also remains coupled to the emitter of the second transistor Q2. The first transistor Q1 and collector resistor R1 are again selected to provide a relatively small variable collector current component $I_{C1}$ (or simply $I_1$) which may vary with variations in line voltage $V_{cc}$. The second and third transistors Q2 and Q2A and emitter resistor R2A according to the new circuit arrangement provide the relatively larger temperature variation countervailing standing collector current component $I_{C2}$ (or simply $I_2$). The collector current components $I_{C1}$ and $I_{C2}$ ($I_1$ and $I_2$) combine to form the shunt regulator transistor collector current $I_C$Q3.

Figure 2:
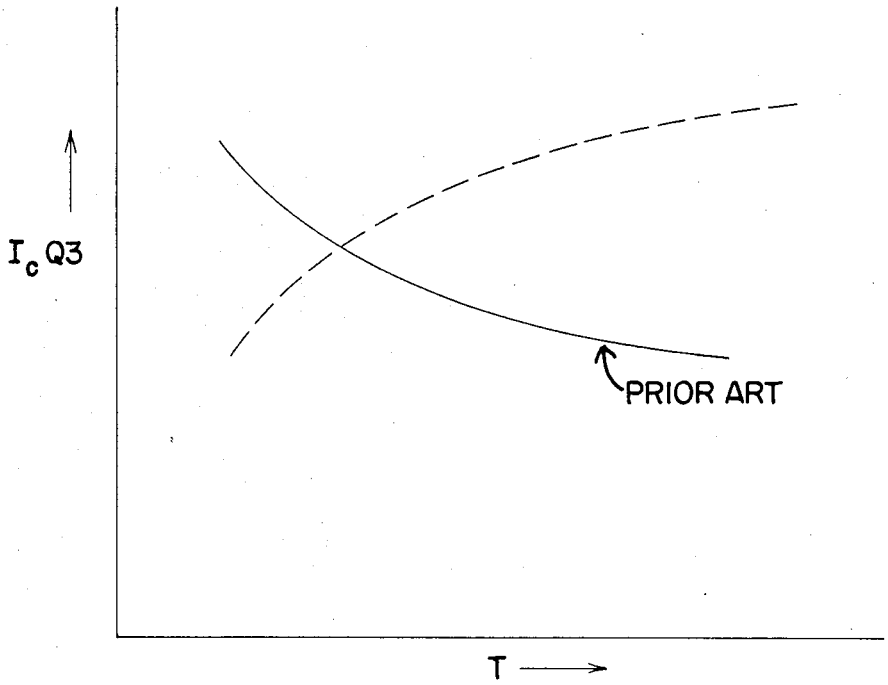
FIG. 2 is a graph of the shunt regulator transistor collector current $I_C$Q3 versus temperature comparing the collector current variation with temperature of the prior art active collector load circuit with the present invention.

The variation of the collector current $I_C$Q3 of shunt regulator transistor Q3 with temperature resulting from the circuit configuration of FIG. 5 is shown by the dashed line of the graph of FIG. 2. As illustrated in FIG. 2, the temperature variation countervailing active collector load circuit of the present invention provides a shunt regulator transistor collector current which increases with increase in temperature, just the inverse or opposite of the results produced by prior art or conventional active collector load circuits. This inverse characteristic curve of collector current variation with temperature has the beneficial effect of compensating for other temperature varying parameters in the bias generator circuit such as the potential $V_{BE}$Q3 across the base emitter junction of shunt regulator transistor Q3. Thus, the temperature variation countervailing active collector load circuit of the present invention provides a shunt regulator transistor collector current which varies in an opposite sense from other temperature sensitive parameters in the bias generator circuit so that, for example, $dV_{BE}/dT \cong K$, where "K" is a constant.

Figure 3:
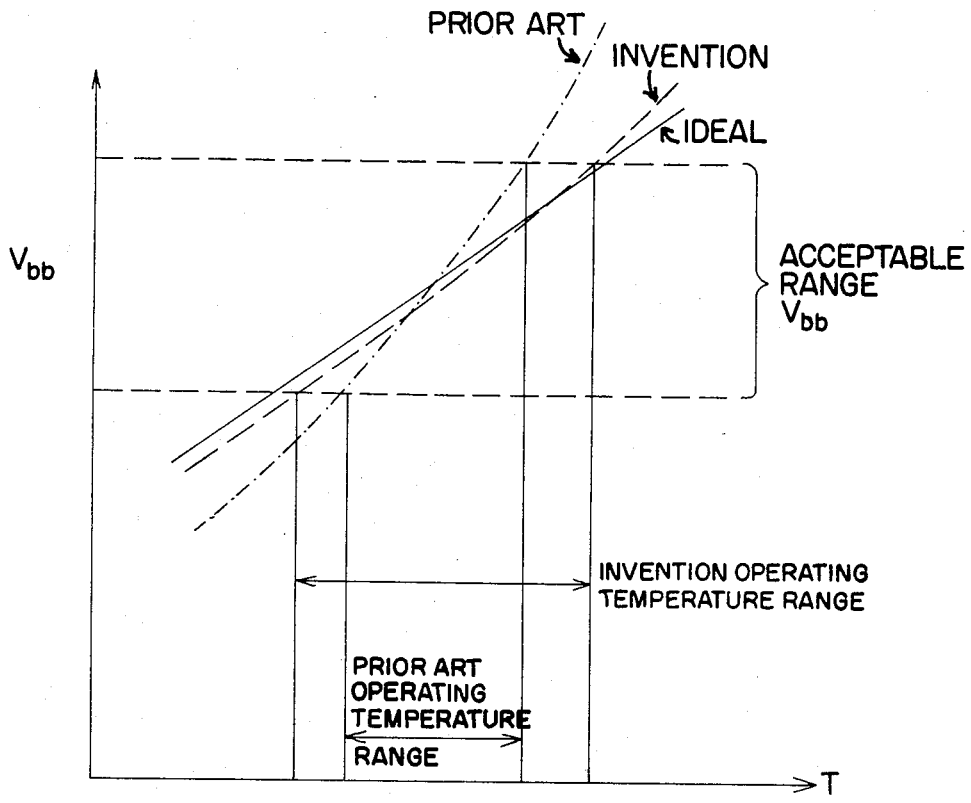
FIG. 3 is a graph of reference voltage $V_{bb}$ versus temperature comparing the operating range of the conventional base generator voltage source with the present invention.

The net result is a more linear dependence of the output of the bias generator voltage source such as the reference voltage source $V_{bb}$ and the current source voltage $V_{cs}$ on temperature change as illustrated by the dashed line, for example, in FIG. 3. The operating temperature range of ECL circuits associated with the bias generator is correspondingly increased.

Moreover, the parameters may be selected to provide a slight increase in the current source voltage $V_{cs}$ of, for example, in the range of 1.1 mv/° C. compatible with existing ECL circuit families that require an ECL voltage swing increase with temperature.

While the invention has been described with reference to particular example embodiments it is intended to cover all modifications and equivalents within the scope of the following claims.

I claim:

1. In a voltage compensated bias generator having a shunt regulator transistor (Q3) with an active collector load circuit to compensate for variations in line voltage $V_{cc}$, said bias generator and shunt regulator transistor providing a compensated voltage source at an output transistor of the bias generator for the current source voltage $V_{cs}$ for ECL circuits, the improvement comprising:

an all NPN active collector load circuit operatively coupled between the line voltage $V_{cc}$ and the collector of the shunt regulator transistor, said active collector load circuit comprising NPN first and second transistors with the base of the first transistor (Q1) coupled to the emitter of the second transistor (Q2) and with the base of the second transistor coupled to the collector of the first transistor, said active collector load circuit being operatively coupled to provide a first relatively smaller changing current ($I_1$) from the emitter of the first transistor which may vary with changes in the line voltage $V_{cc}$, and a relatively larger second substantially unvarying standing current ($I_2$) from the emitter of the second transistor, said changing current and standing current being combined to provide the collector current ($I_CQ3$) to the shunt regulator transistor (Q3) thereby substantially logarithmically reducing variation in collector current from the active collector load circuit to the shunt regulator transistor upon variations in the line voltage $V_{cc}$.

2. The bias generator of claim 1 wherein the all NPN active collector load circuit is operatively coupled in the bias generator so that one of the transistors of the active collector load circuit provides in combination with an output transistor of the bias generator a Darlington transistor pair for sourcing current and driving the current source voltage $V_{cs}$ from the bias generator for ECL circuits.

3. The bias generator of claim 1 wherein the collector of the first transistor of the active collector load circuit is coupled to line voltage $V_{cc}$ through collector resistor $R_1$, wherein the second transistor of the active collector load circuit is coupled in emitter follower configuration with the collector coupled directly to the line voltage $V_{cc}$, and wherein the emitter of said second transistor is coupled through resistor R2 to the collector of the shunt regulator transistor, and wherein R1>>R2 so rhat the changing current component ($I_1$) through collector resistor R1 is relatively small and the substantially unvarying standby current component ($I_2$) through collector resistor R2 is relatively large.

4. The bias generator of claim 1 further comprising a temperature compensating NPN third transistor (Q2A) coupled in the active collector load circuit, said third transistor operatively coupled to the first and second transistors to compensate for variation in the collector current ($I_CQ3$) of the shunt regulator transistor (Q3) with temperature introduced by the active collector load circuit.

5. The bias generator of claim 4 wherein the base of the third transistor (Q2A) is coupled to the base of the first transistor (Q1) and wherein the collector of the third transistor (Q2A) is coupled to the emitter of the second transistor (Q2).

6. The bias generator of claim 5 wherein said third transistor comprises a base collector shorted transistor.

7. The bias generator of claim 6 wherein the emitter of said third transistor is coupled through a resistor (R2A) to the collector of the shunt regulator transistor (Q3).

8. The bias generator of claim 5 wherein said first transistor (Q1) of the active collector load circuit in combination with another NPN transistor (Q5) of the bias generator comprises a Darlington drive current source for sourcing current to the current source voltage output $V_{cs}$ of the bias generator.

9. The bias generator of claim 1 wherein said active collector load circuit further comprises an NPN third transistor (Q2A) operatively coupled in the active collector load circuit to the first and second transistors to offset substantially the effects of temperature variation on the collector current ($I_CQ3$) provided by the active collector load circuit to the collector of the shunt regulator transistor (Q3) and to increase the collector current $I_CQ3$ with increase in temperature.

10. A compensated bias generator having a shunt regulator transistor and an active collector load circuit operatively coupled between the line voltage $V_{cc}$ and the collector of the shunt regulator transistor to compensate for variations in line voltage $V_{cc}$, said bias generator providing a compensated voltage source for the reference voltage $V_{bb}$ and current source voltage $V_{cs}$ for emitter coupled logic (ECL) circuits the improvement comprising:

an all NPN active collector load circuit comprising NPN first and second transistors operatively coupled between the line voltage $V_{cc}$ and the shunt regulator transistor for generating a compensated collector current to the shunt regulator transistor compensating for variations in the line voltage $V_{cc}$, and an NPN third transistor operatively coupled in the active load circuit to the first and second transistors to compensate for variations in the collector current to the shunt regulator transistor introduced by variations in the base emitter voltages of the NPN transistors of the active collector load circuit with variations in temperature thereby providing a voltage and temperature compensated collector current from the active collector load circuit to the shunt regulator transistor.

11. The bias generator of claim 10 wherein the NPN first and second transistors are operatively coupled in the active collective load circuit with the base of the first transistor coupled to the emitter of the second transistor and with the base of the second transistor coupled to the collector of the first transistor for generating a first relatively smaller changing collector current component from the emitter of the first transistor changing with variations in the line Voltage $V_{cc}$, and a second relatively larger standing collector current component from the emitter of the second transistor substantially invariant to variations in the line voltage $V_{cc}$ thereby substantially logarithmically reducing variation in the collector current from the active collector load circuit to the shunt regulator transistor resulting from variations in the line voltage $V_{cc}$, said changing collector current component and standing current component being combined to provide the collector current $I_c$.

12. The bias generator of claim 11 wherein the bias generator comprises further NPN transistors and wherein one of the NPN transistors of the active collector load circuit is operatively coupled in combination with one of the NPN transistors of the bias generator to provide a Darlington drive current source for the current source voltage output $V_{cs}$ of the bias generator.

13. The bias generator of claim 11 wherein the collector of said first transistor is coupled through a first collector resistor R1 to the line voltage $V_{cc}$, wherein the collector of the second transistor is coupled directly to the line voltage $V_{cc}$ affording an emitter follower configuration for said second transistor, and wherein the emitter of the third transistor is operatively coupled through a second resistor R2A to the collector of the shunt regulator transistor, and wherein R2A<<R1 so that the changing collector current component is substantially smaller than the substantially invariant standing collector current component.

14. The bias generator of claim 13 wherein the third transistor of the active collector load circuit is operatively coupled with the base of the third transistor coupled to the base of the first transistor, the collector of the third transistor coupled to the emitter of the second transistor, and the emitter of the third transistor coupled to the second resistor R2A thereby compensating the standing collector current component for variations in temperature.

15. The bias generator of claim 14 wherein said third transistor comprises a base collector shorted transistor.

16. The compensated bias generator of claim 10 wherein the NPN third transistor (Q2A) is operatively coupled in the active collector load circuit to the NPN first and second transistors to increase the collector current to the shunt regulator transistor with increase in temperature.

* * * * *